United States Patent [19]

Van Ulzen

[11] 4,337,543

[45] Jul. 6, 1982

[54] COLLAPSIBLE TRIMARAN BOAT

[76] Inventor: William R. Van Ulzen, 3155 N. U.S. Hwy. 35, La Porte, Ind. 46350

[21] Appl. No.: 199,971

[22] Filed: Oct. 23, 1980

[51] Int. Cl.[3] ..... B63B 35/36

[52] U.S. Cl. ..... 114/354; 114/39; 114/123

[58] Field of Search ..... 9/2 C, 2 F, 2 R, 1.2; 114/123, 61, 39, 292

[56] References Cited

U.S. PATENT DOCUMENTS

| | | | |
|---|---|---|---|
| 2,495,412 | 1/1950 | Gouge . | |
| 3,108,295 | 10/1963 | Schor et al. . | |
| 3,126,558 | 3/1964 | Nolan et al. . | |
| 3,193,851 | 7/1965 | Fiebelkorn | 114/61 X |
| 3,485,198 | 12/1969 | Matthews | 114/123 |
| 3,812,805 | 5/1974 | Forssel et al. . | |
| 3,877,094 | 4/1975 | Kelly | 114/61 X |
| 3,929,085 | 12/1975 | Mason | 114/123 |

*Primary Examiner*—Trygve M. Blix
*Assistant Examiner*—Stephen P. Avila
*Attorney, Agent, or Firm*—Oltsch, Knoblock & Hall

[57] ABSTRACT

A trimaran type boat having center, port, and starboard elongated floats which are hinged together at corresponding juxtaposed side edges to enable the port and starboard floats to be pivoted between an operatable position in which the floats are transversely oriented to accommodate flotation of the boat and a collapsed position in which the port and starboard floats are folded into the center float to reduce the overall width of the boat without appreciably increasing the height so as to facilitate its storage and transport.

5 Claims, 5 Drawing Figures

COLLAPSIBLE TRIMARAN BOAT

SUMMARY OF THE INVENTION

This invention relates to a collapsible boat and will have particular application to that type of boat having three longitudinal floats, known as the trimaran type.

In the boat of this invention there is center, port and starboard longitudinally oriented float sections each of generally triangular cross sectional configuration. The port and starboard float sections are hinge connected to the center float section along corresponding sides so as to enable the port and starboard sections to be pivoted between a storage or collapsed position in which the float sections are folded downwardly against the center float section and an operative position in which the float sections are transversely extended to form a supporting deck for the floating operation of the boat. When the port and starboard float sections are in their collapsed position, the width of the boat is reduced with no appreciable increase in the height of the boat. This enables the boat to be conveniently stored or carried upon a vehicle or car roof, under small airplanes, or be utilized even as a life boat on ships and similar water going vessels. The boat itself can be utilized for rescue operations, fishing, snorkling, scuba diving, and for other recreational pleasures. The boat float sections can be formed out of lightweight foamed plastic material so as to minimize the weight of the boat and facilitate its handling when collapsed. The port and starboard float sections of the boat can be rapidly and simply shifted between collapsed and operative positions with only a minimum of effort.

Accordingly, it is an object of this invention to provide a collapsible trimaran boat which is of simple operation.

Another object of this invention is to provide a trimaran type boat which can be collapsed to reduce its size for storage and transportation purposes.

Another object of this invention is to provide a collapsible boat which is of lightweight construction and which can be utilized for recreational as well as rescue purposes.

Other objects of this invention will become apparent upon a reading of the invention's description.

BRIEF DESCRIPTION OF THE DRAWINGS

A preferred embodiment of this invention has been chosen for purposes of illustration and description wherein.

DESCRIPTION OF THE PREFERRED EMBODIMENT

The preferred embodiment illustrated is not intended to be exhaustive or to limit the invention to the precise form disclosed. It is chosen and described in order to best explain the principles of the invention and its application and practical use to thereby enable others skilled in the art to best utilize the invention.

Figure 3:
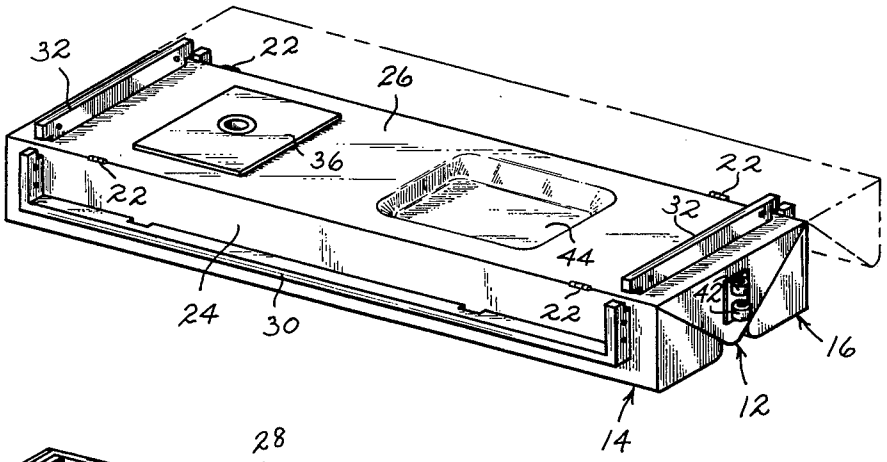
FIG. 3 is a perspective view of the boat shown in its collapsed form with the extended or operative position of one of the float sections being shown in broken lines.

Boat 10 as illustrated in the figures includes a center float section 12, a port float section 14 and a starboard float section 16. Center float section 12 has a general cross section in the form of an inverted isosceles triangle except for its bow section which is formed with a convex curvature. Each of the float sections 14 and 16 has a general cross section in the form of a right angular triangle except for the convex bow section, with the hypotenuse-forming side 18 of each of the float sections being located in a juxtaposed opposing relationship with the sides 20 of center float section 12. Each float section 14 and 16 is connected by hinges 22 to a side edge of center float section 12 at surfaces 24 and 26 of the float sections so that float sections 14 and 16 are pivotal relative to center float section 12 between the collapsed position illustrated in FIG. 3 and the extended or operative position illustrated in FIG. 2. When float sections 14 and 16 are in their collapsed position, sides 18 of the float sections will be positioned against sides 20 of the center float section 12. When float sections 14 and 16 are in their operative position, a spatial relationship exists between sides 20 of center float section 12 and sides 18 of float sections 14 and 16 to form the trimaran hull configuration. Float sections 12, 14 and 16 are water buoyant and are preferably formed of a lightweight plastic foamed material.

Figure 2:
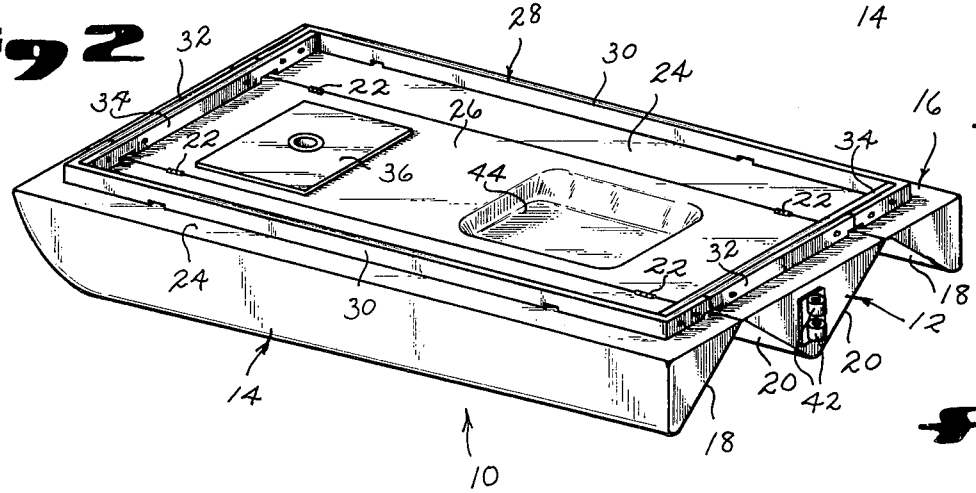
FIG. 2 is a perspective view of the boat shown in its operative form but with the sail removed.
Figure 4:
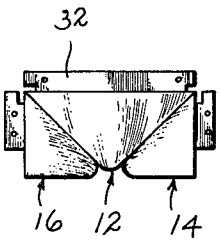
FIG. 4 is a front end view of the boat shown in its collapsed form.
Figure 5:
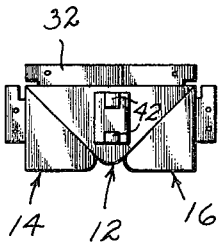
FIG. 5 is a rear end view of the boat shown in its collapsed form.

A gunwale 28 which includes side rails 30 and adjoining end rails 32 are carried upon the surfaces 24 and 26 of float sections 12, 14 and 16. Each float section 14 and 16 carries side rail 30 and an end portion of each end rail 32. Center float section 12 carries the center portions of the end rails 32. When float sections 14 and 16 are in their operative position as illustrated in FIG. 2, side rails 30 and end rails 32 form a rectangular enclosure about the periphery of the deck formed by surfaces 24 and 26 of the float sections. There is an abutment between the center sections of end rails 32 carried upon center float section 12 and the end portions of the end rails 32 carried by float sections 14 and 16 as the float sections are shifted into their operative position to cause surfaces 24 and 26 of the float sections to form a generally co-planar deck and to prevent the float sections from pivoting upwardly over the center float section. Float sections 14 and 16 are locked or secured in their extended or operative position by means of elongated end braces 34 which are secured to the end and center portions of each of the end rails 32 by suitable connectors such as nuts and bolts. End braces 34 prevent float sections 14 and 16 from pivoting relative to center float section 12 during operation and use of boat 10 upon the water.

Figure 1:
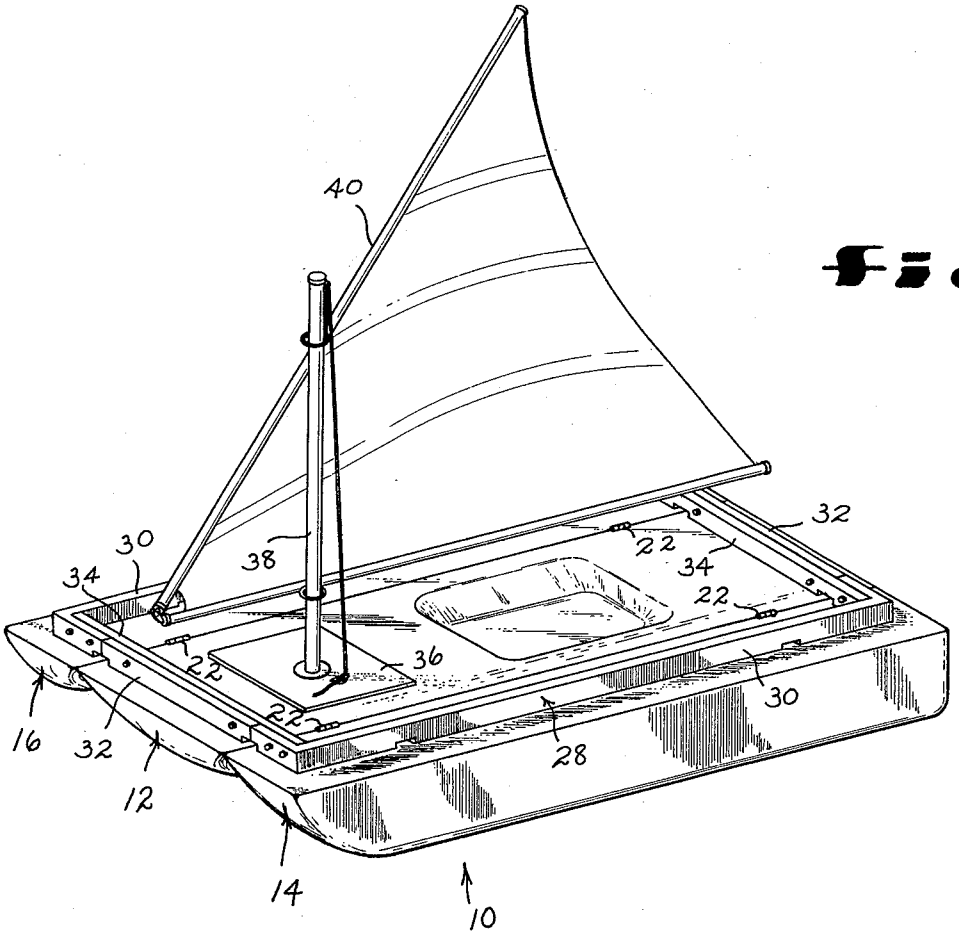
FIG. 1 is a perspective view of the boat shown in its operative form.

Boat 10 illustrated in the figures is of the sailboat type and thus includes a mast mounting plate 36 carried near the bow of center float section 12. Mounting plate 36 is adopted to accommodte the mast 38 of a sail rig 40 as illustrated in FIG. 1. The stern of float section 12 has a pair of rings 42 secured to it for the purpose of receiving the pintle of a rudder. Additionally, center float section 12 may have a cockpit 44 or foot recess formed in its upper surface 26 to accommodate the user of boat 10. To collapse and either store or transport boat 10, end braces 34 are removed to allow float sections 14 and 16 to be pivoted downwardly towards float section 12. Straps or other types of tie devices can be utilized to secure float sections 14 and 16 in their collapsed position against float section 12 if necessary.

It is to be understood the invention is not to be limited to the details above given but may be modified within the scope of the appended claims.

What I claim is:

1. A collapsible trimaran-type boat comprising three parallel individual longitudinal float sections, each float section having two tapering sides and a top surface, said float sections constituting a center section of a generally inverted isosceles triangular cross-sectional configuration and port and starboard sections each of a generally right angle triangular cross-sectional configuration, one side of each port and starboard float section being the hypotenuse of said right angle triangular cross-sectional configuration, hinge components connecting said center float section at one upper corner edge of its top surface to said starboard float section at its top surface at the intersection of said one side thereof, other hinge components connecting said center float section at the opposite upper corner edge to said port float section at its top surface at the intersection of said one side thereof, said port and starboard float sections being pivotal relative to said center float section about said hinge components between a collapsed position where the hypotenuse of each port and starboard float section is juxtaposed with said-side of said center float section resulting in said boat at its float sections having a generally rectangular configuration and an operative floating position where said float section top surfaces are generally planar and said hypotenuses of said port and starboard float sections are angularly displaced from said sides of said center float section, and means for securing said port and starboard float sections in their operative floating position.

2. The boat of claim 1 wherein said port and starboard float section securing means includes parts carried by each of the float sections at their respective top surfaces which abut as the port and starboard float sections are shifted into their operative position to restrict further opening pivotal movement of said port and starboard float sections about said hinge components.

3. The boat of claim 2 wherein said abutment parts constitute a rail carried by said float section top surfaces.

4. The boat of claim 3 and a securement member constituting a component of said port and starboard float section securing means removably connected across said abutment parts when the port and starboard float sections are in their operative position to prevent further movement of the port and starboard float sections about said hinge components.

5. The boat of claim 1 and a cockpit formed in said top surface of said center float section.

* * * * *